US009476652B2

(12) United States Patent
Wu

(10) Patent No.: US 9,476,652 B2
(45) Date of Patent: Oct. 25, 2016

(54) THIN HEAT PIPE STRUCTURE HAVING ENLARGED CONDENSING SECTION

(75) Inventor: Chun-Ming Wu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 485 days.

(21) Appl. No.: 13/342,981

(22) Filed: Jan. 4, 2012

(65) Prior Publication Data

US 2013/0168053 A1 Jul. 4, 2013

(51) Int. Cl.
*F28D 15/04* (2006.01)
*F28D 15/02* (2006.01)

(52) U.S. Cl.
CPC ..... *F28D 15/0233* (2013.01); *F28D 15/04* (2013.01); *F28D 15/046* (2013.01); *Y10T 29/49353* (2015.01)

(58) Field of Classification Search
CPC ..... F28D 15/0233; F28D 15/04
USPC ..... 165/104.21, 104.26; 29/890.032
See application file for complete search history.

(56) References Cited

U.S. PATENT DOCUMENTS

| | | | | |
|---|---|---|---|---|
| 7,246,655 | B2 * | 7/2007 | Mochizuki et al. | 165/104.26 |
| 2008/0245511 | A1 * | 10/2008 | Lai | 165/104.26 |
| 2012/0037344 | A1 * | 2/2012 | Meyer et al. | 165/104.26 |
| 2012/0279687 | A1 * | 11/2012 | Meyer et al. | 165/104.26 |

FOREIGN PATENT DOCUMENTS

| | | | | |
|---|---|---|---|---|
| CN | 1887037 | A | 12/2006 | |
| CN | 101839660 | A | 9/2010 | |
| CN | 202329326 | U | 7/2012 | |
| JP | 200213887 | A1 * | 6/2000 | F28D 15/02 |
| TW | 200732616 | A | 9/2007 | |
| TW | I288224 | | 10/2007 | |
| TW | I325045 | | 5/2008 | |
| TW | M375861 | | 3/2010 | |
| TW | 2010038899 | A1 | 11/2010 | |
| TW | M393660 | U1 | 12/2010 | |

* cited by examiner

*Primary Examiner* — Travis Ruby
*Assistant Examiner* — Harry Arant
(74) *Attorney, Agent, or Firm* — C. G. Mersereau; Nikolai & Mersereau, P.A.

(57) ABSTRACT

A thin heat pipe structure includes a pipe body and at least one wick structure. The pipe body has a vaporizing end internally defining a first chamber, and a condensing end internally defining a second chamber communicating with the first chamber. A space in the first chamber is smaller than that in the second chamber. The wick structure is provided in the first and the second chamber, such that at least one channel is defined in the pipe body by the wick structure and the first and second chambers. With the above arrangements, the pressure resistance in the pipe body at the condensing end is reduced to thereby enable upgraded vapor-liquid circulation efficiency of the working fluid in the pipe body and accordingly upgraded heat dissipation effect of the thin heat pipe structure. A method of forming the thin heat pipe structure is also disclosed.

3 Claims, 4 Drawing Sheets

THIN HEAT PIPE STRUCTURE HAVING ENLARGED CONDENSING SECTION

FIELD OF THE INVENTION

The present invention relates to a thin heat pipe structure, and more particularly to a thin heat pipe structure that has reduced internal pressure resistance to thereby enable upgraded vapor-liquid circulation efficiency of a working fluid in the thin heat pipe structure. The present invention also relates to a method of forming the above thin heat pipe structure.

BACKGROUND OF THE INVENTION

A heat pipe has a surface thermal conductance several to several ten times as high as that of copper and aluminum, and is therefore an excellent cooling device often employed in heat-removing related apparatus. According to its shape, the heat pipe can be generally divided into a round heat pipe and a plane heat pipe. For cooling a heat-producing element in an electronic device, such as a central processing unit (CPU), the plane heat pipe is more suitable for use to dissipate heat because it can be more easily mounted on and have a larger contact area with the heat-producing element. Due to the demands for miniaturized cooling mechanism to save space, it becomes absolutely necessary to develop a heat pipe with extremely low profile. Therefore, a thin heat pipe, i.e. a flat plate heat pipe, has been developed by related manufacturers.

A conventional thin heat pipe has an internal space for receiving a working fluid therein and used as a flow passage for the working fluid. When the working fluid in the thin heat pipe is heated at a vaporizing end thereof and changes from a liquid phase into a vapor phase and therefore flows from the vaporizing end to an opposite condensing end of the thin heat pipe, heat produced by a heat-producing element is transferred via the thin heat pipe from the vaporizing end to the condensing end to achieve the heat transfer and dissipation effect.

To manufacture the conventional thin heat pipe, a type of metal powder is filled in a hollow pipe. The metal powder is sintered to form a wick structure layer on inner surfaces of the hollow pipe. The hollow pipe is then evacuated and filled with a working fluid before being flattened to form a thin heat pipe structure.

While the conventional thin heat pipe has a relatively low profile, it has another problem to be solved. That is, the vaporizing end and the condensing end of the conventional thin heat pipe have the same pipe size, so that the spaces in the vaporizing end and the condensing end are also the same in volume. With this design, there is almost little pressure difference between the spaces of the vaporizing end and the condensing end. As a result, the vapor-phase working fluid can not quickly flow from the vaporizing end to the condensing end for cooling and converting into the liquid phase, which in turn adversely affects the rate at which the liquid-phase working fluid flows from the condensing end via the wick structure back to the vaporizing end. Therefore, the vapor-liquid circulation in the whole thin heat pipe is poor and there is no way to solve the problem of pressure resistance between the vaporizing end and the condensing end of the thin heat pipe.

In addition, when the conventional thin heat pipe is bent during the manufacturing process, the sintered wick structure layer inside the thin heat pipe is brittle and tends to break or separate from the inner surfaces of the thin heat pipe, rendering the thin heat pipe a defective product having largely lowered heat transfer performance.

In brief, the conventional thin heat pipe has the following disadvantages: (1) having poor vapor-liquid circulation efficiency; (2) providing low heat transfer and dissipation performance; and (3) failing to solve the problem of high pressure resistance between the vaporizing end and the condensing end of the thin heat pipe.

It is therefore tried by the inventor to develop an improved thin heat pipe structure to overcome the disadvantages in the conventional thin heat pipe.

SUMMARY OF THE INVENTION

A primary object of the present invention is to provide a thin heat pipe structure that has reduced internal pressure resistance to thereby enable upgraded vapor-liquid circulation efficiency of a working fluid in the thin heat pipe structure.

Another object of the present invention is to provide a thin heat pipe structure that provides excellent heat transfer and dissipation effect.

A further object of the present invention is to provide a method of forming a thin heat pipe structure that has reduced internal pressure resistance to thereby enable upgraded vapor-liquid circulation efficiency of a working fluid in the thin heat pipe structure.

A still further object of the present invention is to provide a method of forming a thin heat pipe structure that provides excellent heat transfer and dissipation effect.

To achieve the above and other objects, the thin heat pipe structure according to a preferred embodiment of the present invention includes a pipe body and at least one wick structure. The pipe body has a vaporizing end and a condensing end outwardly extended from the vaporizing end. The vaporizing end and the condensing end internally define a first chamber and a second chamber, respectively. A working fluid is filled in the first and the second chamber. And, a space in the first chamber is smaller than that in the second chamber. The at least one wick structure is provided in the first and the second chamber, such that the wick structure and the first and second chambers together define at least one channel in the pipe body. Since the space in the second chamber at the condensing end is larger than that in the first chamber at the vaporizing end, the pressure resistance at the condensing end is reduced and the vapor-phase working fluid is driven to more quickly flow from the vaporizing end to the condensing end, so that an upgraded vapor-liquid circulation efficiency in the pipe body can be achieved.

To achieve the above and other objects, a first embodiment of the method of forming thin heat pipe structure according to the present invention includes the steps of providing a pipe body internally defining a first and a second chamber, and at least one wick structure, wherein a space in the first chamber is smaller than that in the second chamber; positioning the wick structure in the first and second chambers of the pipe body, and performing a mechanical processing on the pipe body; and sealing two ends of the pipe body, and evacuating the pipe body before filling a working fluid thereinto. With the above forming method, a thin heat pipe structure with reduced internal pressure resistance and upgraded vapor-liquid circulation efficiency can be obtained.

A second embodiment of the method of forming thin heat pipe structure according to the present invention includes the steps of providing a pipe body internally defining a first and a second chamber, and at least one wick structure, wherein a space in the first chamber is smaller than that in the second chamber; positioning the wick structure in the first and second chambers of the pipe body; sealing two ends of the pipe body, and evacuating the pipe body before filling a working fluid thereinto; and performing a mechanical processing on the sealed pipe body. With the above forming method, a thin heat pipe structure with reduced internal pressure resistance and upgraded vapor-liquid circulation efficiency can also be obtained.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and with reference to the accompanying drawings.

Figure 1:
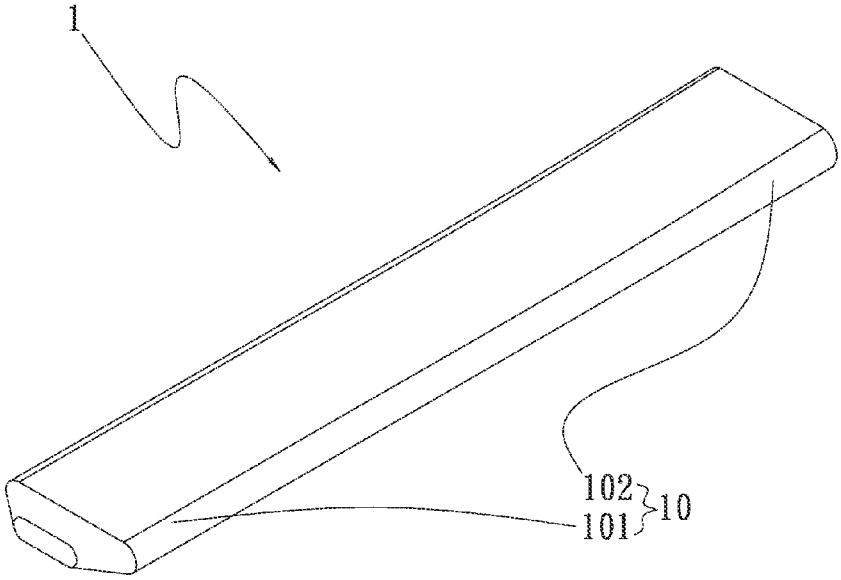
FIG. 1 is a perspective view of a thin heat pipe structure according to a preferred embodiment of the present invention.
Figure 2:
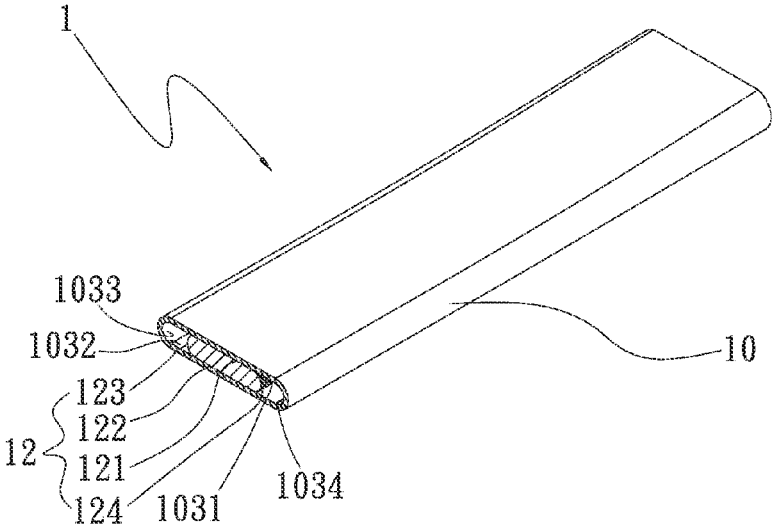
FIG. 2 is a cross-sectional perspective view of the thin heat pipe structure of FIG. 1.
Figure 4:
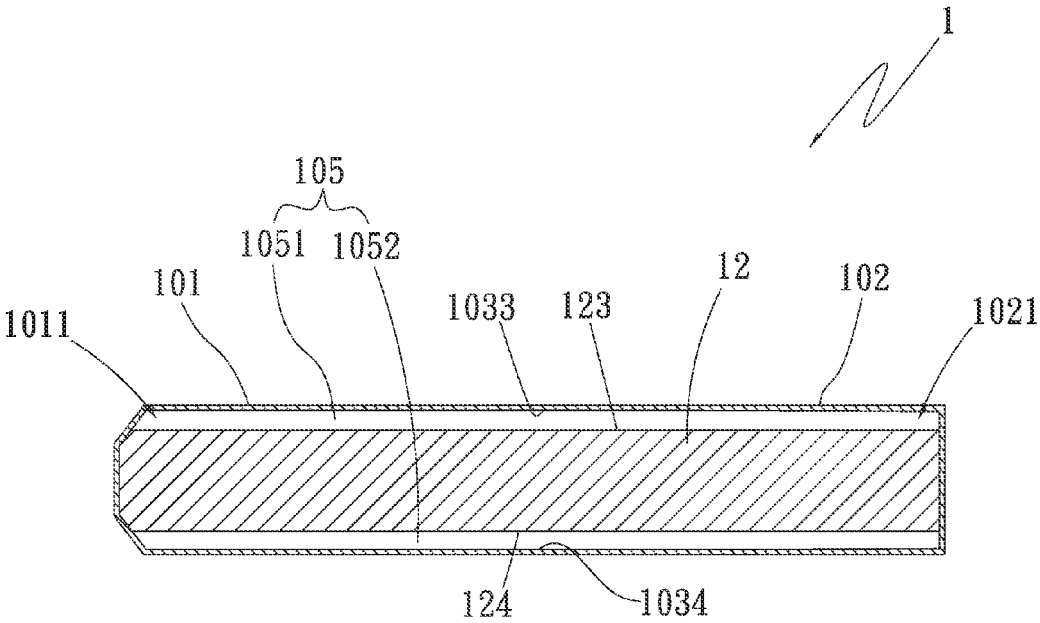
FIG. 4 is a sectional top view of the thin heat pipe structure of FIG. 1.

Please refer to FIG. 1 that is a perspective view of a thin heat pipe structure 1 according to a preferred embodiment of the present invention; and to FIGS. 2 and 4 that are cross-sectional perspective view and sectional top view, respectively, of the thin heat pipe structure 1 of FIG. 1. As shown, the thin heat pipe structure 1 includes a pipe body 10 and at least one wick structure 12. The pipe body 10 has a vaporizing end 101 and a condensing end 102 outwardly extended from the vaporizing end 101. The vaporizing end 101 and the condensing end 102 of the pipe body 10 internally define a first chamber 1011 and a second chamber 1021, respectively; and the first and the second chamber 1011, 1021 are communicable with each other. It is noted a space in the first chamber 1011 is smaller than that in the second chamber 1021. A working fluid is filled in the first and second chambers 1011, 1021. In a preferred embodiment, the working fluid can be purified water without being restricted thereto. In practical implementation of the present invention, the working fluid may be any other fluid suitable for vaporizing and accordingly dissipating heat, such as inorganic compounds, alcohol, ketones, liquid metals, coolant, organic compounds, or any mixture thereof.

The first and second chambers 1011, 1021 commonly have a first sidewall 1031, a second sidewall 1032, a third sidewall 1033, and a fourth sidewall 1034. The first sidewall 1031 is located opposite to the second sidewall 1032, and the third sidewall 1033 is located opposite to the fourth sidewall 1034.

The vaporizing end 101 of the pipe body 10 is in contact with a heat producing element, such as a central processing unit (CPU), a graphics chip, a south bridge chip, a north bridge chip, or an executing unit (not shown), for absorbing heat produced by the heat producing element. The working fluid in the first chamber 1011 is initially in a liquid phase and is heated and vaporized by the heat absorbed by the vaporizing end 101 of the pipe body 10 to convert into a vapor-phase working fluid. The vapor-phase working fluid flows toward the second chamber 1021 at the condensing end 102 of the pipe body 10 and is cooled and condensed into the liquid-phase working fluid again. The liquid-phase working fluid then flows back to the first chamber 1011 at the vaporizing end 101 by gravity or via the wick structure 12 to start another vapor-liquid circulation cycle. In this manner, it is able to achieve excellent heat dissipation effect.

Since the second chamber 1021 at the condensing end 102 of the pipe body 10 is larger than the first chamber 1011 at the vaporizing end 101, the pressure resistance in the second chamber 1021 is reduced, allowing the vapor-phase working fluid to more quickly flow toward the second chamber 1021. The reduced pressure resistance in the second chamber 1021 also allows the liquid-phase working fluid at the condensing end 102 to more quickly flow back to the first chamber 1011 at the vaporizing end 101. Therefore, the thin heat pipe structure 1 of the present invention provides the effects of reduced pressure resistance at the condensing end 102 and largely upgraded vapor-liquid circulation rate in the thin heat pipe structure.

In practical implementation of the present invention, the condensing end 102 can be extended through or in contact with a radiating assembly (not shown), so that the heat transferred to the condensing end 102 by the vapor-phase working fluid can be further transferred to the radiating assembly and more quickly radiated into ambient air to effectively shorten the time needed for the vapor-phase working fluid to condense into the liquid-phase working fluid at the condensing end 102.

Figure 3:
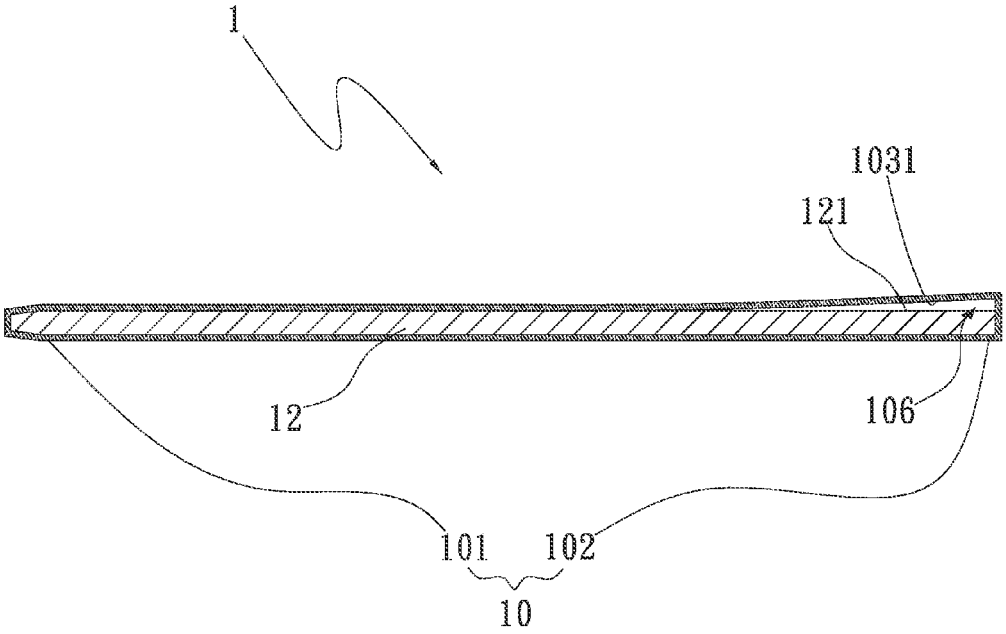
FIG. 3 is a longitudinal sectional view of the thin heat pipe structure of FIG. 1.

FIG. 3 is a longitudinal sectional view of the thin heat pipe structure 1 of the present invention. Please refer to FIGS. 3 and 4 along with FIG. 2. The wick structure 12 can be meshes, fibers, sintered powder, or a combination of meshes and sintered powder. The wick structure 12 is provided in the first and the second chamber 1011, 1021 and has many functions, such as guiding the flow of working fluid, providing more return channels in the pipe body 10, and serving as a supporting structure in the pipe body 10. The wick structure 12 and the first and second chambers 1011, 1021 together define at least one channel 105 in the pipe body 10. In the illustrated preferred embodiment, the wick structure 12 is provided in middle spaces of the first and the second chamber 1011, 1021, as shown in FIGS. 3 and 4, so as to define two channels 105 in the first and the second chamber 1011, 1021.

More specifically, the wick structure 12 has a first side 121, a second side 122 opposite to the first side 121, a third side 123, and a fourth side 124 opposite to the third side 123. The second side 122 of the wick structure 12 is in contact with the second sidewall 1032; the third side 123 of the wick structure 12 and the third sidewall 1033 together define a first channel 1051 between them; the fourth side 124 of the wick structure 12 and the fourth sidewall 1034 together define a second channel 1052 between them; a portion of the first sidewall 1031 in the first chamber 1011 is in contact with the first side 121 of the wick structure 12; and another portion of the first sidewall 1031 in the second chamber 1021 and the first side 121 of the wick structure 12 together define an interspace 106 between them. The interspace 106 communicates with the first and the second channel 1051, 1052.

Therefore, an overall space of the first and the second channel 1051, 1052 in the first chamber 1011 at the vaporizing end 101 is smaller than a total space defined by the first and the second channel 1051, 1052 and the interspace 106 in the second chamber 1021 at the condensing end 102. That is, the interspace 106 widens the first and the second channel 1051, 1052 in the second chamber 1021 to thereby largely reduce the pressure resistance in the second chamber 1021 at the condensing end 102, which favorably drives the vapor-phase working fluid in the first chamber 1011 at the vaporizing end 101 to more quickly flow toward the second chamber 1021. In this manner, the vapor-liquid circulation rate in the thin heat pipe structure is largely upgraded to enable excellent heat dissipation effect of the thin heat pipe structure.

In practical implementation of the present invention, the wick structure 12 is not necessarily restricted to locate in the middle areas of the first and the second chamber 1011, 1021, but can be selectively arranged on the common third sidewall 1033 or the common fourth sidewall 1034 of the first and the second chamber 1011, 1021, or be arranged on positions between the third and the fourth sidewall 1033, 1034. Moreover, a user may previously determine the number of the wick structures 12 and of the channels 105 according to the width of the pipe body 10, the required heat transfer efficiency, and the required vapor-liquid circulation efficiency. For example, two wick structures 12 may be arranged in the first and the second chamber 1011, 1021 so that three channels 105 may be defined in the pipe body 10 by the wick structures 12 and the first and second chambers 1011, 1021.

With the second chamber 1021 at the condensing end 102 of the pipe body 10 being formed larger than the first chamber 1011 at the vaporizing end 101 of the pipe body 10, and with the wick structure 12 being positioned in the pipe body 10, the thin heat pipe structure 1 of the present invention may have reduced internal pressure resistance to thereby have effectively upgraded vapor-liquid circulation efficiency and excellent heat dissipation effect.

Figure 5:
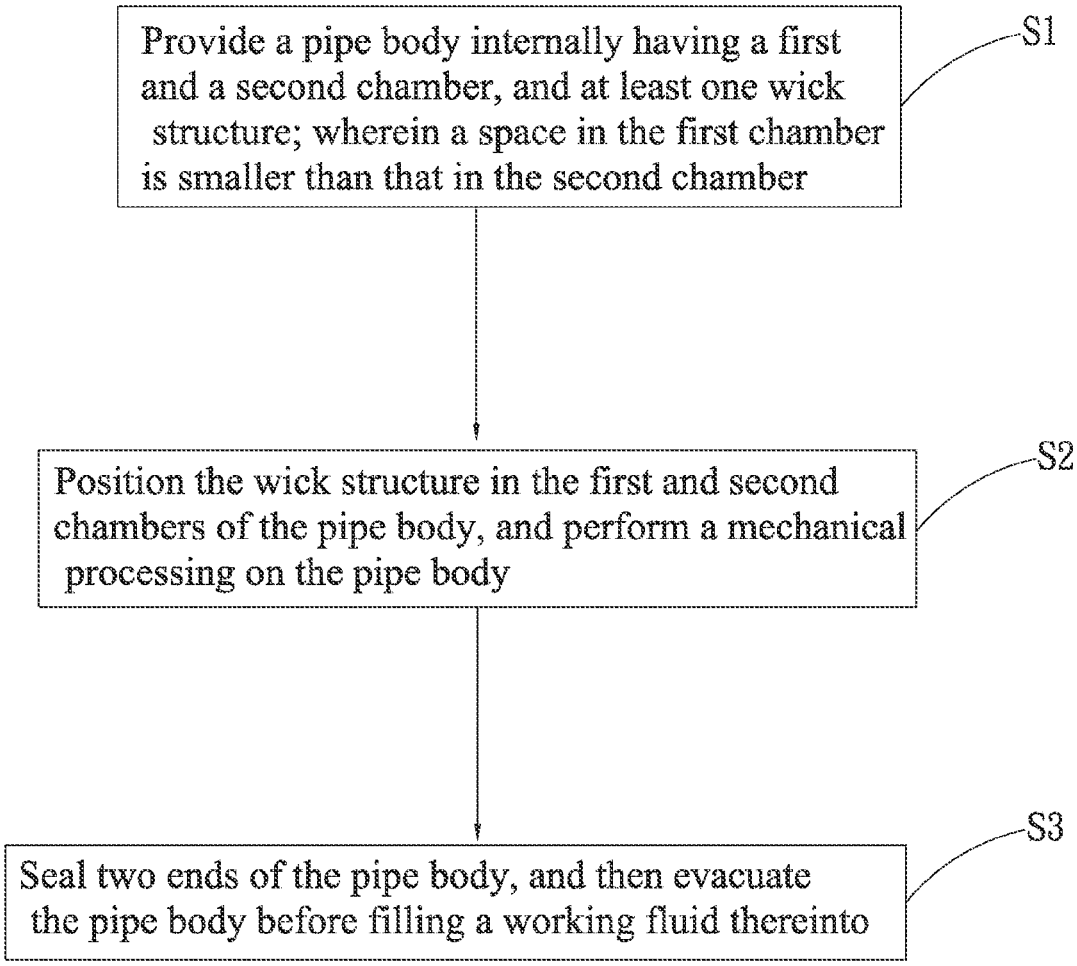
FIG. 5 is a flowchart showing the steps included in a first embodiment of a method of forming thin heat pipe structure according to the present invention.

FIG. 5 is a flowchart showing the steps S1, S2, and S3 included in a first embodiment of a method of forming thin heat pipe structure according to the present invention. Please refer to FIG. 5 along with FIGS. 1 to 4.

In the first step S1, a pipe body internally having a first and a second chamber as well as at least one wick structure are provided; and a space in the first chamber is smaller than that in the second chamber.

More specifically, a pipe body 10 internally having a first and a second chamber 1011, 1021 as well as at least one wick structure 12 are provided. The first chamber 1011 is located in the pipe body 10 at a vaporizing end 101 thereof, and the second chamber 1021 is located in the pipe body 10 at an opposite condensing end 102 thereof. The pipe body 10 is so formed that the space in the first chamber 1011 is smaller than that in the second chamber 1021. Further, the wick structure 12 can be meshes, fibers, sintered powder structures, or any combination of meshes and sintered powder structures.

In the second step S2, the wick structure is positioned in the first and the second chamber, and the pipe body is subjected to a mechanical processing.

More specifically, the wick structure 12 is positioned in the first and the second chamber 1011, 1021; and then a mechanical processing is performed on the pipe body 10 from an end, such as the vaporizing end 101, to another end, such as the condensing end 102. And, the mechanical processing may be stamping or rolling.

In the third step S3, the pipe body is sealed at two ends and is then evacuated before a working fluid is filled thereinto.

More specifically, two ends, i.e. the vaporizing end 101 and the condensing end 102, of the pipe body 10 are sealed, and the pipe body 10 is then evacuated before a working fluid is filled into the first and the second chamber 1011, 1021.

With the thin heat pipe structure of the present invention, the pressure resistance in the second chamber 1021 at the condensing end 102 can be reduced for the vapor-phase working fluid in the first chamber 1011 at the vaporizing end 101 to more quickly flow to the second chamber 1021, so that the vapor-liquid circulation rate in the pipe body 10 is increased and the heat dissipation effect of the thin heat pipe structure is upgraded.

Figure 6:
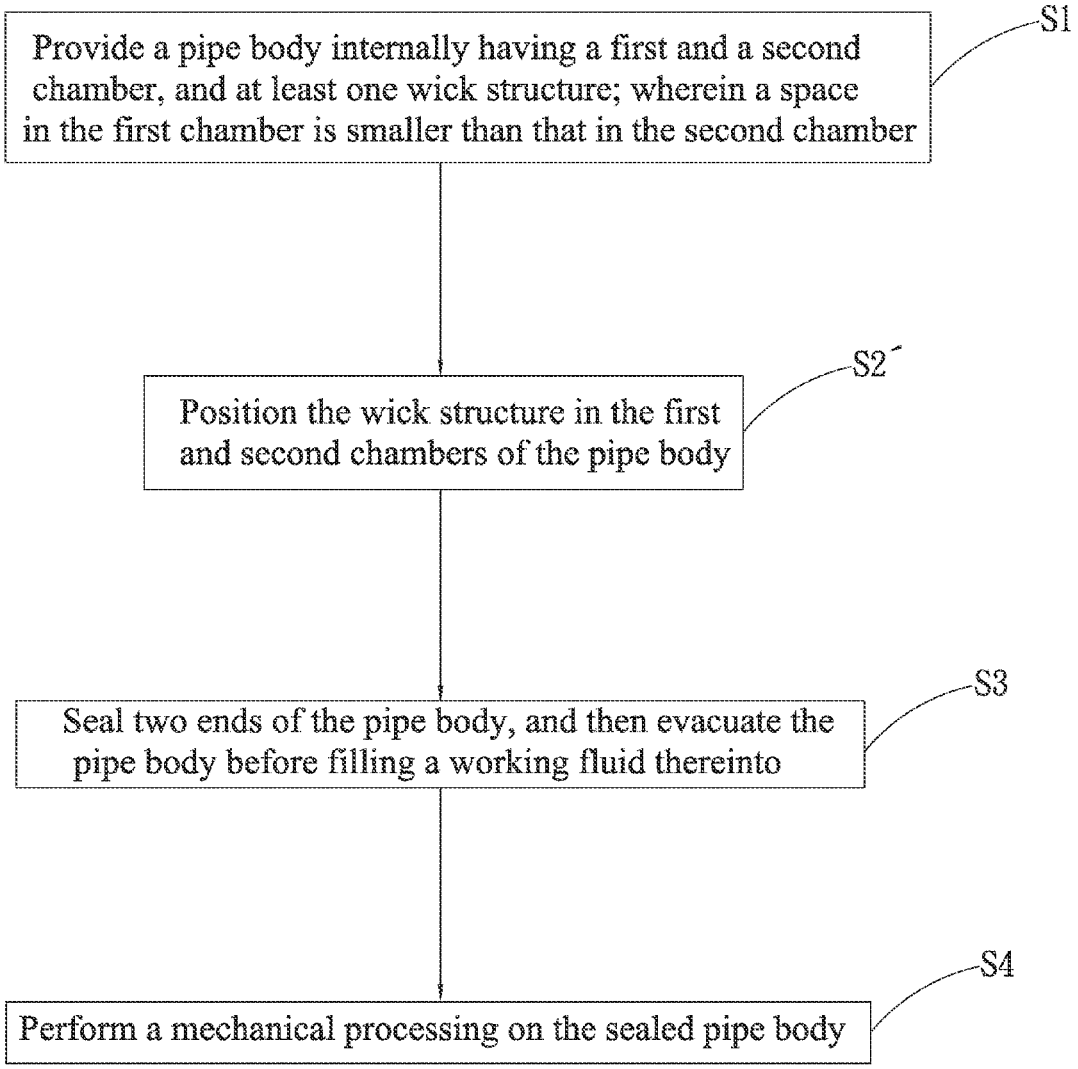
FIG. 6 is a flowchart showing the steps included in a second embodiment of the method of forming thin heat pipe structure according to the present invention.

FIG. 6 is a flowchart showing the steps S1, S2', S3 and S4 included in a second embodiment of the method of forming thin heat pipe structure according to the present invention. Please refer to FIG. 6 along with FIGS. 1 to 4.

In the first step S1, a pipe body internally having a first and a second chamber as well as at least one wick structure are provided; and a space in the first chamber is smaller than that in the second chamber.

More specifically, a pipe body 10 internally having a first and a second chamber 1011, 1021 as well as at least one wick structure 12 are provided. The first chamber 1011 is located in the pipe body 10 at a vaporizing end 101 thereof, and the second chamber 1021 is located in the pipe body 10 at an opposite condensing end 102 thereof. The pipe body 10 is so formed that the space in the first chamber 1011 is smaller than that in the second chamber 1021. Further, the wick structure 12 can be meshes, fibers, sintered powder structures, or any combination of meshes and sintered powder structures.

In the second step S2', the wick structure is positioned in the first and the second chamber.

More specifically, the wick structure 12 is positioned in the first and the second chamber 1011, 1021.

In the third step S3, the pipe body is sealed at two ends and is then evacuated before a working fluid is filled thereinto.

More specifically, two ends, i.e. the vaporizing end 101 and the condensing end 102, of the pipe body 10 are sealed, and the pipe body 10 is then evacuated before a working fluid is filled into the first and the second chamber 1011, 1021.

In the fourth step S4, the sealed pipe body is subjected to a mechanical processing.

More specifically, the sealed pipe body 10 having the working fluid filled therein is subjected to a mechanical processing from an end, such as the vaporizing end 101, to another end, such as the condensing end 102. And, the mechanical processing may be stamping or rolling.

With the above arrangements, the thin heat pipe structure 1 of the present invention has a second chamber 1021 in the pipe body 10 at the condensing end 102 larger than a first chamber 1011 in the pipe body 10 at the vaporizing end 101, so that the pressure resistance in the second chamber 1021 is reduced and the vapor-phase working fluid can more quickly flow to the second chamber 1021 and be cooled and converted to the liquid-phase working fluid again to flow back to the first chamber 1011. That is, the vapor-liquid circulation rate in the pipe body 10 is increased to enable excellent heat dissipation effect.

In brief, the present invention is superior to the conventional thin heat pipe due to the following advantages: (1) having upgraded vapor-liquid circulation efficiency; (2) providing good heat transfer effect; and (3) having reduced internal pressure resistance in the pipe body.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A thin heat pipe structure, comprising:

a pipe body having a vaporizing end and a condensing end outwardly extended from the vaporizing end; the vaporizing end and the condensing end internally defining a first chamber and a second chamber which communicates with the first chamber, respectively; a working fluid being filled in the first and the second chamber; the condensing end being gradually enlarged beginning beyond the vaporizing end, such that a cross-sectional area of the pipe body at the vaporizing end is smaller than that at the condensing end there being an extended inclined sidewall region of constant slope extending completely to the end of the condensing end giving increased open condensing volume; and a space in the first chamber being smaller than a space in the second chamber; and at least one wick structure being provided in the first and the second chamber, such that the wick structure and the first and second chambers together define at least one channel in the pipe body;

wherein the first and the second chamber commonly have a first sidewall, a second sidewall, a third sidewall, and a fourth sidewall; the first sidewall being located opposite to the second sidewall, and the third sidewall being located opposite to the fourth sidewall; and wherein the wick structure has a first side, a second side located opposite to the first side, a third side, and a fourth side located opposite to the third side; the second side being in contact with the second sidewall; the third side being located corresponding to the third sidewall with a first channel defined between the third side and the third sidewall; the fourth side being located corresponding to the fourth sidewall with a second channel defined between the fourth side and the fourth sidewall; a portion of the first sidewall in the first channel at the vaporizing end being in contact with a whole surface of the first side of the wick structure, and wherein another portion of the first sidewall in the second channel at the condensing end is not attached to the wick structure such that together with the first side of the wick structure define an interspace between the wick structure and the first sidewall; and wherein the interspace is communicable with the first and the second channel; and wherein the first and second channels are not provided with the wick structure.

2. The thin heat pipe structure as claimed in claim 1, wherein an overall space defined by a portion of the first and of the second channel in the first chamber is smaller than a total space defined by another portion of the first and of the second channel in the second chamber and the interspace.

3. The thin heat pipe structure as claimed in claim 1, wherein the wick structure is selected from the group consisting of meshes, fibers, sintered powder structures and any combination of meshes and sintered powder structures.

* * * * *